US008393397B2

(12) United States Patent
Trewhella et al.

(10) Patent No.: US 8,393,397 B2
(45) Date of Patent: Mar. 12, 2013

(54) APPARATUS AND METHOD FOR SEPARATING A TUBULAR STRING FROM A SUBSEA WELL INSTALLATION

(75) Inventors: Ross John Trewhella, Houston, TX (US); Darryl K. Mackie, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 415 days.

(21) Appl. No.: 12/725,566

(22) Filed: Mar. 17, 2010

(65) Prior Publication Data

US 2011/0226482 A1 Sep. 22, 2011

(51) Int. Cl.
*E21B 23/00* (2006.01)

(52) U.S. Cl. ..... 166/340; 166/377; 166/378; 166/381; 166/382

(58) Field of Classification Search ..... 166/338, 166/339, 340, 345, 350, 351, 355, 359, 363, 166/364, 365, 367, 334.1, 85.1, 85.4
See application file for complete search history.

(56) References Cited

U.S. PATENT DOCUMENTS

| | | | | |
|---|---|---|---|---|
| 4,658,904 | A * | 4/1987 | Doremus et al. | 166/336 |
| 6,026,905 | A | 2/2000 | Garcia-Soule | |
| 6,293,344 | B1 | 9/2001 | Nixon et al. | |
| 6,691,784 | B1 | 2/2004 | Wanvik | |
| 7,240,734 | B2 | 7/2007 | Nivens et al. | |
| 7,395,866 | B2 | 7/2008 | Milberger et al. | |
| 2004/0173356 | A1 * | 9/2004 | Dore et al. | 166/345 |
| 2005/0263288 | A1 * | 12/2005 | Moe | 166/355 |

* cited by examiner

*Primary Examiner* — Thomas Beach
*Assistant Examiner* — James Sayre
(74) *Attorney, Agent, or Firm* — Lawrence R. Youst

(57) ABSTRACT

An apparatus for separating a tubular string from a subsea well installation. The apparatus includes a heave compensator tensioning the tubular string, a subsea actuator assembly positioned within the tubular string, a subsea controller in communication with the subsea actuator assembly, a subsea safety tree positioned within the subsea well installation and a fluid delivery subsystem. An output signal generated by the subsea controller responsive to receipt of a predetermined input signal releases a piston of the subsea actuator assembly such that the tension in the tubular string shifts the piston relative to a cylinder energizing fluid in the fluid delivery subsystem to actuate the retainer valve, the shut-in valve assembly, the vent sleeve and the latch assembly, thereby safely separating the tubular string from a subsea well installation.

19 Claims, 5 Drawing Sheets

APPARATUS AND METHOD FOR SEPARATING A TUBULAR STRING FROM A SUBSEA WELL INSTALLATION

FIELD OF THE INVENTION

This invention relates, in general, to equipment utilized in conjunction with operations performed in relation to subsea wells and, in particular, to an apparatus and method for disconnecting a tubular string from a subsea well installation.

BACKGROUND OF THE INVENTION

Without limiting the scope of the present invention, its background is described with reference to separating a tubular string from a subsea well installation in an emergency situation, as an example.

In many deep water offshore well operations, tubular members such as risers, work strings, production strings and the like are connected between a floating surface vessel and a subsea well installation. Such offshore facilities include various safety systems that automatically prevent fluid communication between the well and the vessel in the event of emergency conditions such as when the vessel must drive away from the location of the subsea well installation. Such drive away conditions may occur as a result of a malfunction of one or more components of a positioning system of a dynamically positioned vessel, the breaking of a tensioned cable of a moored vessel, an effort to avoid bad weather or the like.

In certain installations, the safety systems may include a subsea safety tree on the lower end of the tubular string that may be positioned within the blowout preventer stack of a subsea wellhead. The subsea safety tree may include one or more shut-in valves that operate to automatically shut-in the well. In addition, the subsea safety tree may include a latch assembly that enables separation of the tubular string from the lower portion of the subsea safety tree, a retainer valve that prevents fluid discharge from the tubular string into the environment and a vent sleeve that provides for controlled venting of pressure trapped between the closed retainer valve and the closed shut-in valves of the subsea safety tree.

Conventionally, each of these components of the subsea safety tree, the retainer valve, the vent sleeve, the latch assembly and the shut-in valves, are controlled by fluid pressure in control lines which extend from a pressure source on the vessel to the subsea safety tree. In many installations, dedicated control lines between each of the components and the surface are used, including both supply lines and return lines. In addition, the actuation of each of these components is controlled by electrical switches, such as solenoid valves, that selectively prevent and allow hydraulic pressure to operate the various components. Accordingly, in an emergency situation wherein disconnection of the tubular string from the subsea well installation is required, the proper operation of each of these independent control systems is necessary to safely shut-in the well, contain fluid within the tubular string, bleed off pressure between the shut-in valves and the retainer valve and cause separation of the tubular string from the subsea well installation.

Therefore, a need has arisen for an apparatus and method for disconnecting a tubular string from a subsea well installation in an emergency situation that has improved reliability. A need has also arisen for such an apparatus and method that simplifies the control system required to execute an emergency disconnection of a tubular string from a subsea well installation. Further, a need has arisen for such an apparatus and method that reduces the time required to execute an emergency disconnection of a tubular string from a subsea well installation.

SUMMARY OF THE INVENTION

The present invention disclosed herein is directed to an apparatus and method for disconnecting a tubular string from a subsea well installation that has improved reliability. In addition, the apparatus and method of the present invention simplify the control system required to execute a disconnection of a tubular string from a subsea well installation. Also, the apparatus and method of the present invention reduce the time required to execute a disconnection of a tubular string from a subsea well installation.

In one aspect, the present invention is directed to an apparatus for separating a tubular string from a subsea well installation. The apparatus includes a heave compensator operable to place the tubular string in tension. A subsea actuator assembly is positioned within the tubular string. The subsea actuator assembly includes a piston and a cylinder that define a chamber therebetween. The piston is initially fixed relative to the cylinder and the chamber initially contains a supply of operating fluid. A subsea controller is operably associated with the subsea actuator assembly. A subsea safety tree is operably associated with the tubular string. The subsea safety tree includes a retainer valve, a shut-in valve assembly, a vent sleeve and a latch assembly. A fluid delivery subsystem is in fluid communication with the chamber and the retainer valve, the shut-in valve assembly, the vent sleeve and the latch assembly. The subsea controller generates an output signal responsive to receipt of a predetermined input signal. The output signal releases the piston such that the tension in the tubular string shifts the piston relative to the cylinder causing the operating fluid within the chamber to energize the fluid delivery subsystem, thereby actuating the retainer valve, the shut-in valve assembly, the vent sleeve and the latch assembly.

In one embodiment, the retainer valve is actuated to a closed position to prevent fluid loss from the tubular string, the shut-in valve assembly is actuated to a closed position to shut in the well, the vent sleeve is actuated to an open position to bleeding off pressure between the retainer valve and the shut-in valve assembly and the latch assembly is actuated to an unlatched position to separate the tubular string from the subsea well installation. In another embodiment, the heave compensator is a riser tensioner. In an additional embodiment, the output signal generated by the subsea controller is a hydraulic output signal and the predetermined input signal received by the subsea controller is an electrical input signal. In a further embodiment, the subsea actuator assembly includes a sleeve and a locking assembly that initially retain the piston fixed relative to the cylinder. In this embodiment, the sleeve is operable to be shifted from a first position, in which the sleeve radially secures the locking assembly relative to the piston and a second position, in which the sleeve allows radial movement of the locking assembly relative to the piston, thereby releasing the piston. In yet another embodiment, the fluid delivery subsystem is a common hydraulic subsystem. In this and other embodiments, the common hydraulic subsystem may include a fluid return subsystem in fluid communication with the chamber and the retainer valve, the shut-in valve assembly, the vent sleeve and the latch assembly.

In another aspect, the present invention is directed to a method for separating a tubular string from a subsea well installation operably associated with a subsea well. The method includes placing the tubular string in tension, generating an output signal with a subsea controller responsive to receipt of a predetermined input signal by the subsea controller, receiving the output signal at a subsea actuator assembly and applying the tension force to the subsea actuator assembly, energizing fluid in an operating fluid delivery subsystem in fluid communication with subsea actuator assembly and a retainer valve, a shut-in valve assembly, a vent sleeve and a latch assembly and actuating the retainer valve, the shut-in valve assembly, the vent sleeve and the latch assembly responsive to the energized fluid.

The method may also include operating a heave compensator, generating a hydraulic output signal, receiving an electrical input signal, shifting a sleeve and releasing a locking assembly within the subsea actuator assembly, axially shifting a piston relative to a cylinder of the subsea actuator assembly, discharging a fluid from a chamber between the piston and the cylinder into the operating fluid delivery subsystem, energizing a common hydraulic subsystem and receiving return fluid in the subsea actuator assembly from an operating fluid return subsystem in fluid communication with the retainer valve, the shut-in valve assembly, the vent sleeve and the latch assembly. In addition, the method may include closing the retainer valve to prevent fluid loss from the tubular, closing the shut-in valve assembly to shut in the well, opening the vent sleeve to bleed off pressure between the retainer valve and the shut-in valve assembly and energizing an unlatch mechanism in the latch assembly to separate the tubular string from the subsea well installation.

In a further aspect, the present invention is directed to an apparatus for separating a floating facility from a subsea well installation. The apparatus includes a heave compensator operably associated with the floating facility. A tubular string is supported in tension by the heave compensator. The tubular string includes a subsea safety tree operably associated with the subsea well installation. The subsea safety tree includes a retainer valve, a shut-in valve assembly, a vent sleeve and a latch assembly. A subsea actuator assembly is positioned within the tubular string. The subsea actuator assembly has a piston initially fixed relative to a cylinder that define a chamber therebetween. A subsea controller is operably associated with the subsea actuator assembly. A fluid delivery subsystem is in fluid communication with the chamber and the retainer valve, the shut-in valve assembly, the vent sleeve and the latch assembly. The subsea controller generates an output signal that releases the piston such that the tension in the tubular string shifts the piston relative to the cylinder causing operating fluid within the chamber to energize the fluid delivery subsystem to actuate the retainer valve, the shut-in valve assembly, the vent sleeve and the latch assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
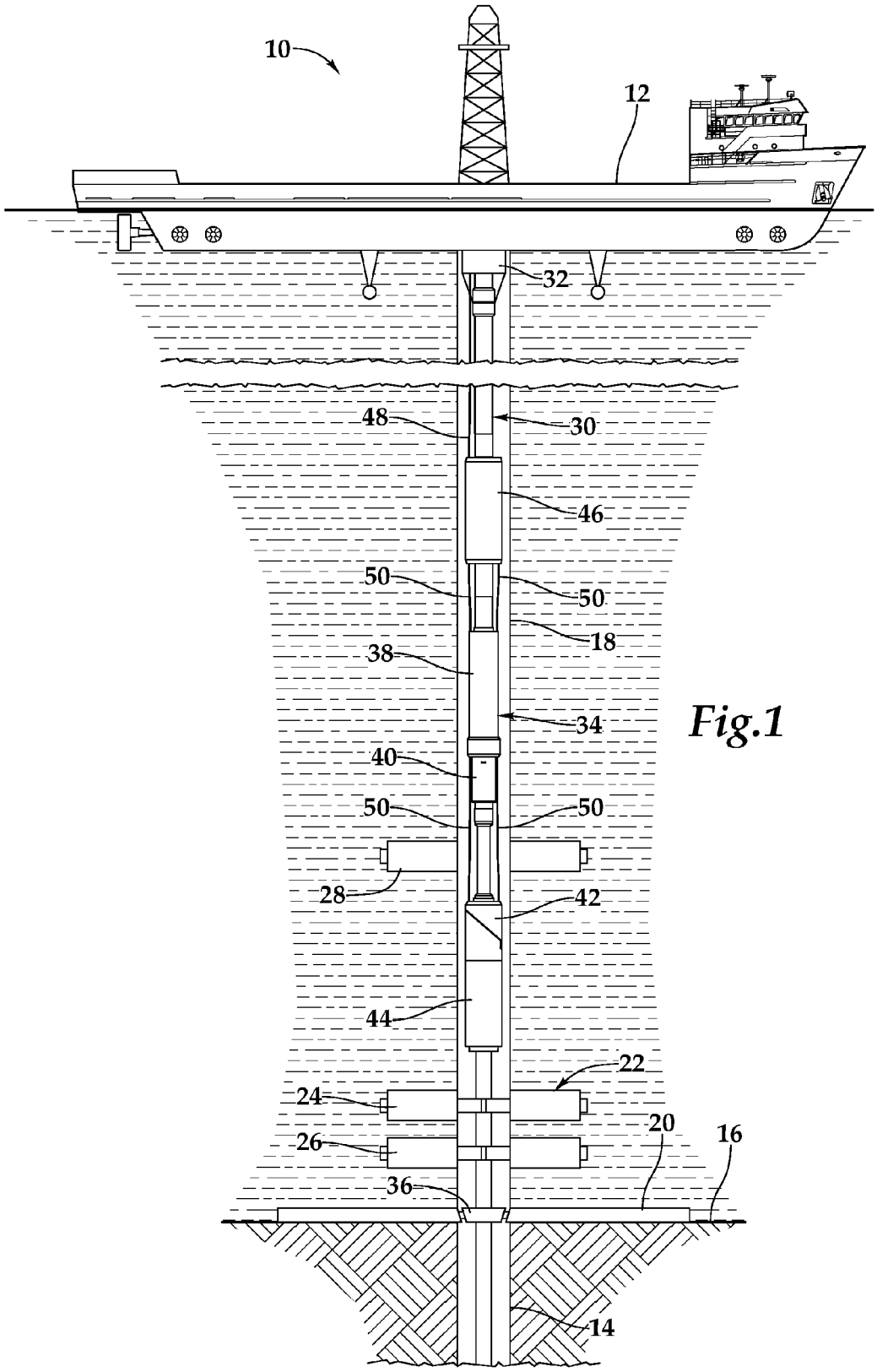
FIG. 1 is a schematic illustrations of a subsea production facility positioned above a subsea well operating an apparatus for disconnecting a tubular string from a subsea well installation according to an embodiment of the present invention.
Figure 2A:
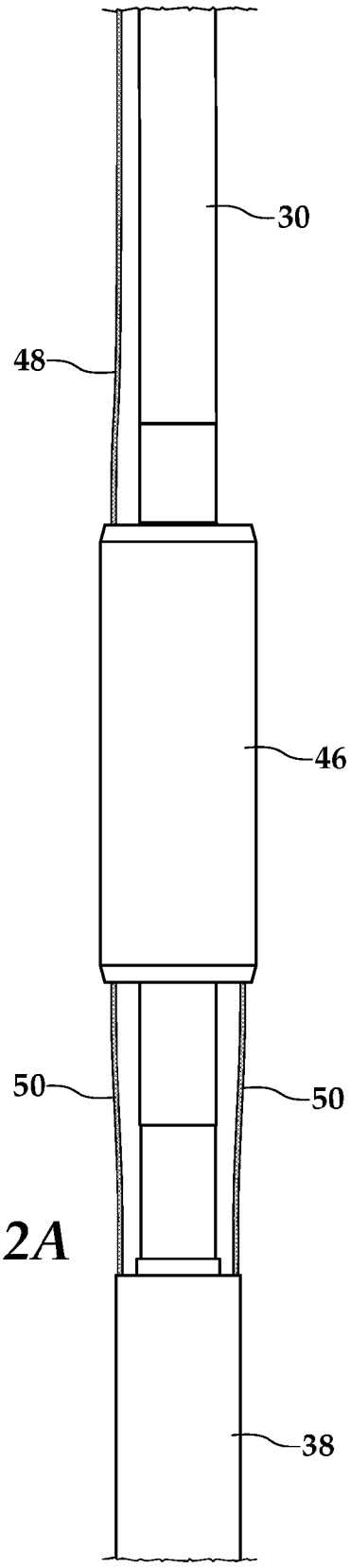
FIGS. 2A-2B are side elevation views of consecutive axial sections of an apparatus for disconnecting a tubular string from a subsea well installation in a first operating configuration according to an embodiment of the present invention.
Figure 2B:
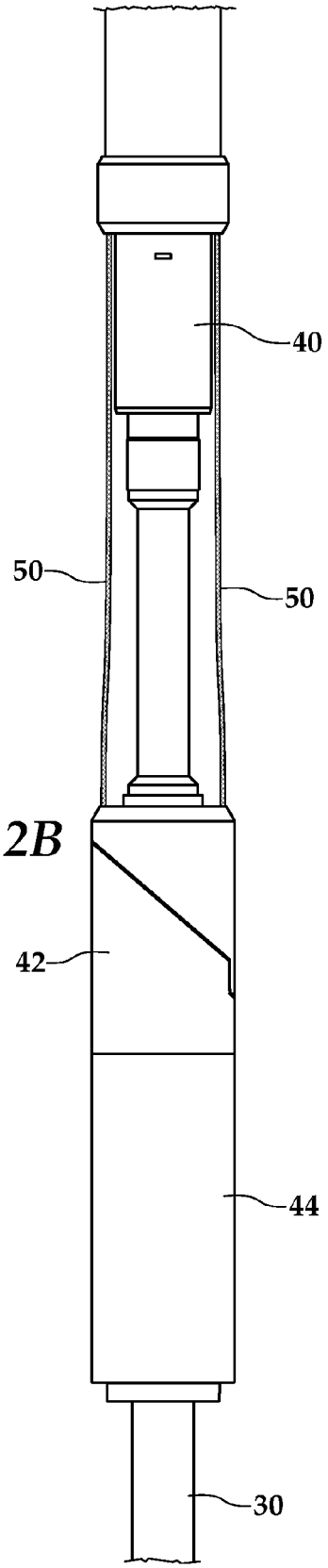

Referring initially to FIG. 1, a subsea production facility positioned above a subsea well including an apparatus for disconnecting a tubular string from a subsea well installation is schematically illustrated and generally designated 10. A floating oil and gas drilling and production platform facility 12 is centered over a subsea well 14 below seafloor 16. A subsea conduit 18 extends from floating facility 12 to a subsea well installation 20, including blowout preventer stack 22 that includes two pipe rams 24, 26 and a shear ram 28 being configured and controlled according to conventional practice. While a typical blowout preventer stack 22 having multiple pipe and shear rams has been depicted, but it is to be clearly understood that other types of blowout preventer stacks have other configurations with both a greater or lesser numbers of pipe and shear rams may be used in conjunction with the present invention.

Disposed within subsea conduit 18 and extending from floating facility 12 to subsea well installation 20 is a tubular string 30. Tubular string 30 is supported at its upper end by a heave compensator depicted as a riser tensioner 32 being configured and operated according to conventional practice to maintain tubular string 30 in tension and to compensate for oscillatory and non-oscillatory motion of floating facility 12. At its lower end, tubular string 30 includes a subsea safety tree 34 that is at least partially positioned within blowout preventer stack 22. A fluted wedge 36 attached below subsea safety tree 34 permits accurate positioning of subsea safety tree 34 within blowout preventer stack 22.

Subsea safety tree 34 includes a retainer valve 38, a vent sleeve 40, a latch assembly 42 and a shut-in valve assembly 44. Retainer valve 38 is designed to remain with tubular string 30 and is operable to prevent fluid loss from tubular string 30 into the environment when tubular string 30 is detached from subsea well installation 20 as described below. Preferably, retainer valve 38 includes one or more valves, such as ball valves, which are operative to selectively permit and prevent fluid flow through a flow passage, formed through retainer valve 38 and are operated to the closed position upon actuation of retainer valve 38.

Vent sleeve 40 is designed to remain with tubular string 30 and is operable to bleeding off pressure between retainer valve 38 and shut-in valve assembly 44 into subsea conduit 18 after retainer valve 38 and shut-in valve assembly 44 have been closed but before tubular string 30 is detached from subsea well installation 20. Preferably, vent sleeve 40 includes one or more valves, such as sliding sleeves that may be operated to the open position upon actuation of vent sleeve 40. Vent sleeve 40 is positioned above the location of shear rams 28 which may be actuated to shear the upper portion of tubular string 30 above the latch assembly 42 in certain situations.

Latch assembly 42 is positioned below the location of shear rams 28. Latch assembly 42 includes upper and lower members that may be decoupled from one another such that an upper portion of tubular string 30 may be separated from a lower portion of tubular string 30. For example, in the illustrated embodiment, the upper portion of tubular string 30 includes retainer valve 38 and vent sleeve 40 which is decoupled from a lower portion of tubular string 30 that includes shut-in valve assembly 44.

Shut-in valve assembly 44 is designed to remain with well installation 20 and is operable to shut in the well upon actuation. Preferably, shut-in valve assembly 44 includes one or more valves, such as ball valves, which are operative to selectively permit and prevent fluid flow through a flow passage formed through shut-in valve assembly 44. Shut-in valve assembly 44 is positioned between shear rams 28 and pipe rams 24, 26. In the illustrated embodiment, pipe rams 24, 26 are in sealing engagement with tubular string 30 below shut-in valve assembly 44.

As best seen in FIGS. 2A-3B, tubular string 30 also includes an apparatus for disconnecting tubular string from subsea well installation 20 that is depicted as a subsea actuator assembly 46. Command and control signals from a surface controller (not pictured) are sent to subsea actuator assembly 46 via umbilical line 48 that may include one or more hydraulic fluid conduits as well as one or more electrical or optical conduits. Preferably, input signals in the form of electrical or optical command signals are sent to a subsea controller (not pictured) that is operably associated with subsea actuator assembly 46. It should be noted, however, by those skilled in the art that the input signals could alternatively be in the form of wireless telemetry signals between telemetry devices without departing from the principles of the present invention. The subsea controller interprets the input signals and generates an output signal. For example, the subsea controller may include a valve, such as a solenoid valve, that is operated from a closed to an open state to allow hydraulic fluid from a hydraulic fluid conduit of umbilical line 48 to pass therethrough. The hydraulic fluid serves as the output signal that initiates operation of subsea actuator assembly 46, as described below.

Figure 3A:
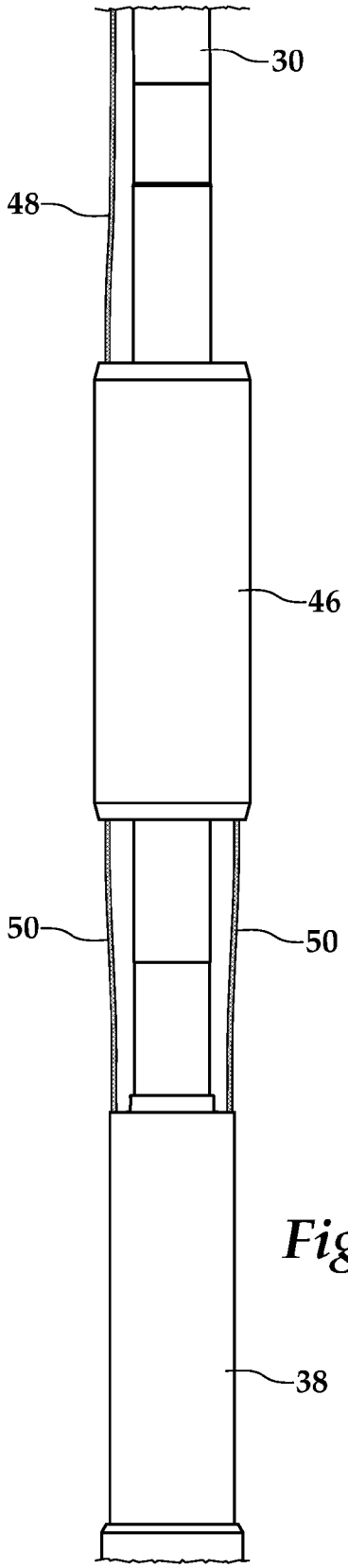
FIGS. 3A-3B are side elevation views of consecutive axial sections of an apparatus for disconnecting a tubular string from a subsea well installation in a second operating configuration according to an embodiment of the present invention.
Figure 3B:
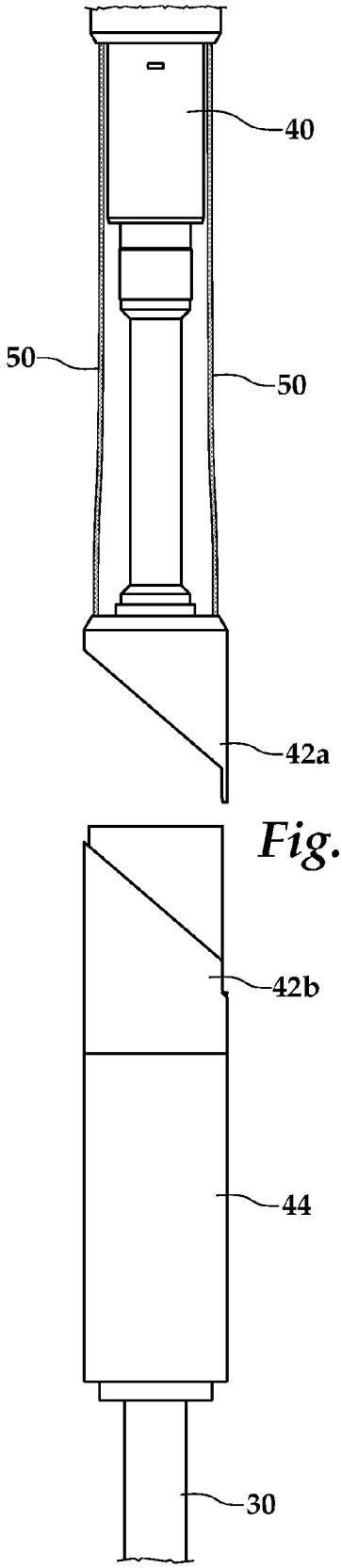

Upon operation, subsea actuator assembly 46 energizes fluid within a fluid delivery subsystem 50 that is in fluid communication with retainer valve 38, shut-in valve assembly 44, vent sleeve 40 and latch assembly 42. The energized fluid within fluid delivery subsystem 50 actuates retainer valve 38 to a closed position to prevent fluid loss from the tubular string, actuates shut-in valve assembly 44 to a closed position to shut in the well, actuates vent sleeve 40 to an open position to bleeding off pressure between retainer valve 38 and the shut-in valve assembly 44 and actuates latch assembly 42 to an unlatched position, as depicted in FIG. 3B as items 42*a* and 42*b*, to separate tubular string 30 from subsea well installation 20.

Figure 4:
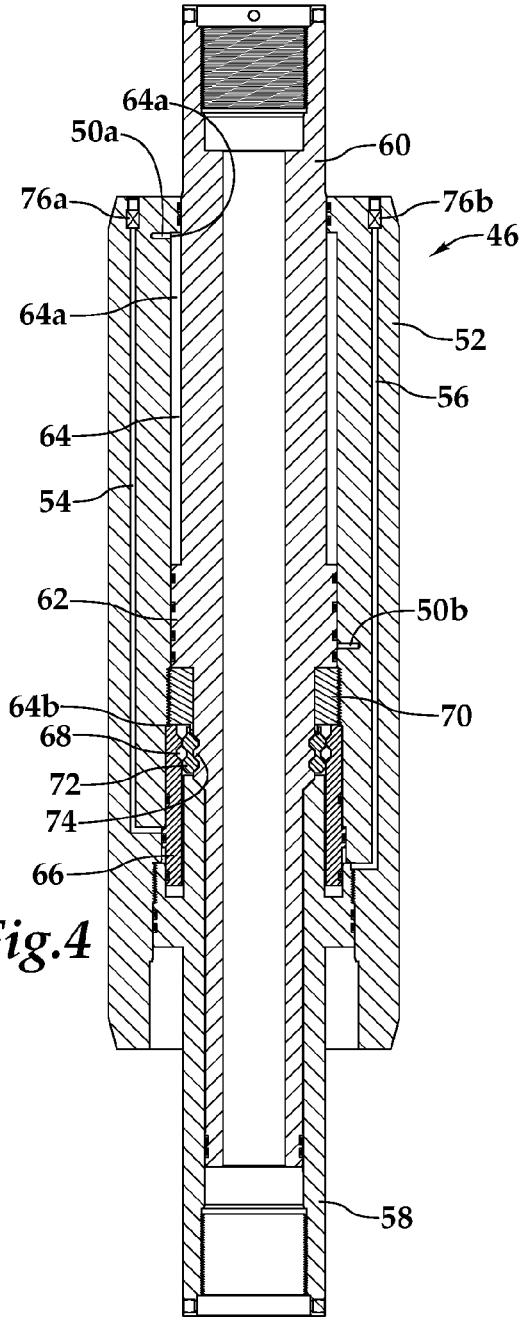
FIG. 4 is a cross sectional view of an apparatus for disconnecting a tubular string from a subsea well installation in a first operating configuration according to an embodiment of the present invention.
Figure 5:
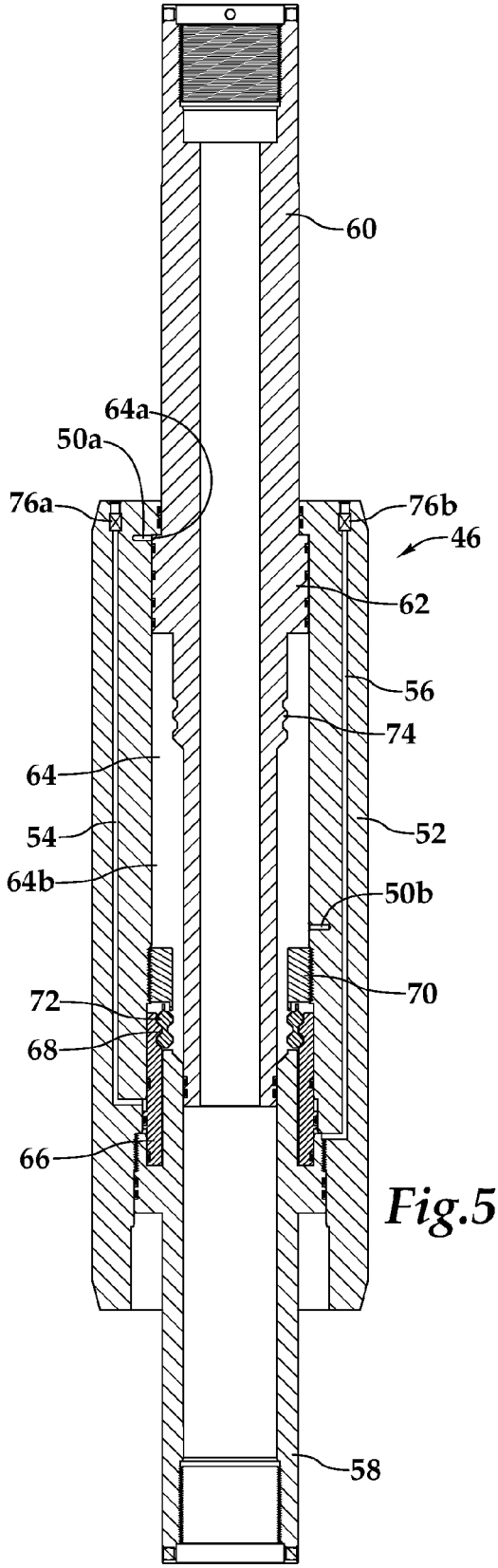
FIG. 5 is a cross sectional view of an apparatus for disconnecting a tubular string from a subsea well installation in a second operating configuration according to an embodiment of the present invention.

Referring next to FIGS. 4-5, therein is depicted an apparatus for disconnecting a tubular string from a subsea well installation that is depicted as a subsea actuator assembly and generally designated 46. Subsea actuator assembly 46 has an outer tubular body 52. Formed within outer tubular body 52 is a plurality of hydraulic pathways that enable operation of the present invention. In the illustrated cross section, supply line 54 and return line 56 are visible. In addition, portions of fluid delivery subsystem 50 are visible, namely an inlet of the supply side 50*a* of fluid delivery subsystem 50 and an outlet of the return side 50*b* of fluid delivery subsystem 50. Even though a single inlet and a single outlet have been depicted, those skilled in the art will recognize that multiple inlets and multiple outlets could alternatively be associated with fluid delivery subsystem 50 without departing from the principle of the present invention. In addition, a single fluid path or multiple independent fluid paths may exist within outer tubular body 52 for each of the supply side 50*a* and the return side 50*b* of fluid delivery subsystem 50.

Securably and sealingly positioned within the lower end of outer tubular body 52 is an adaptor member 58 that is designed to enable connection with other components of the tubular string. Slidably and sealing positioned within outer tubular body 52 and adaptor member 58 is a piston 60 having a radially expanded portion 62. Together, outer tubular body 52 and piston 60 define an operating fluid chamber 64 that is divided into an upper chamber section 64*a*, as best seen in FIG. 4, and a lower chamber portion 64*b*, as best seen in FIG. 5. As such, outer tubular body 52 acts as a cylinder for piston 60. Slidably and sealing positioned between outer tubular body 52 and adaptor member 58 is a prop sleeve 66 having a mating profile 68. Securably coupled to outer tubular body 52 is a retained ring 70. Positioned between piston 60 and prop sleeve 66 is a locking assembly 72. Initially, as best seen in FIG. 4, locking assembly 72 is radially secured within a profiled section 74 of piston 60 by prop sleeve 66 such that piston 60 is axially fixed relative to outer tubular body 52. In the illustrated embodiment, a subsea controller 76 is positioned at least partially within subsea actuator assembly 46 and is depicted as control elements 76*a* and 76*b*.

Figure 6:
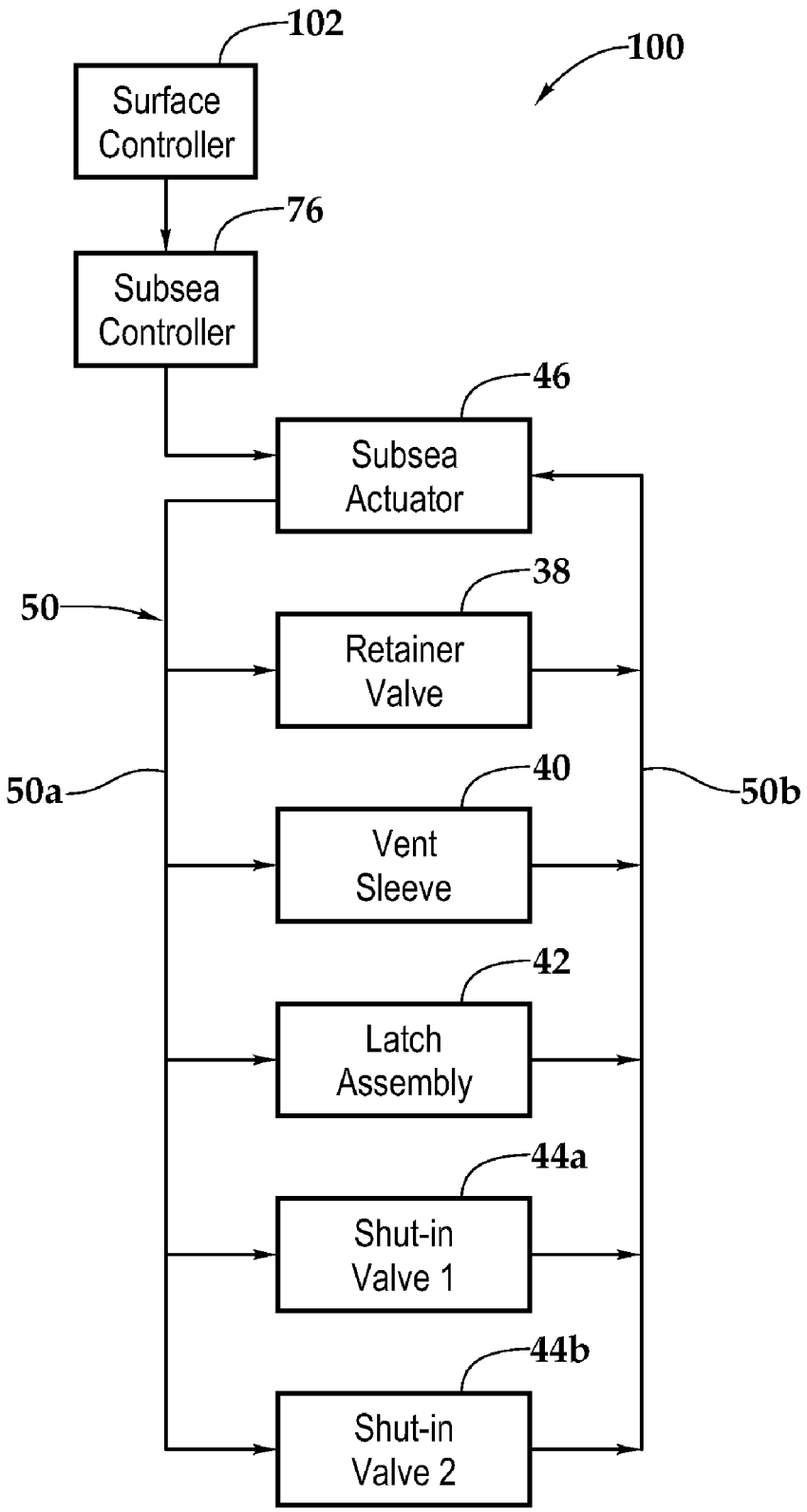
FIG. 6 is a block diagram of a control system associated with an apparatus for disconnecting a tubular string from a subsea well installation according to an embodiment of the present invention.

Referring additionally now to FIG. 6, an operating method 100 of the apparatus for disconnecting a tubular string from a subsea well installation will now be described. Tubular string 30 is placed in tension through the use of riser tensioner 32. In the event that floating facility 12 must drive away from subsea well installation 20, a surface controller 102 is used to send an input signal, such as an electrical signal, to subsea controller 76. The input signal causes subsea controller 76 to generate an output signal, such as by shifting a valve and allowing a hydraulic fluid to pass therethrough. The hydraulic output signal is received and processed by subsea actuator assembly 46, such as by shifting prop sleeve 66 from its propping position, as best seen in FIG. 4, to its release position, as best seen in FIG. 5. Once prop sleeve 66 has shifted, locking assembly 72 radially disengages from profile 74 of piston 60. In this configuration, the tension force applied to tubular string 30 by riser tensioner 32 acts on piston 30 causing piston 30 to shift from its locked position relative to outer body 52, as best seen in FIG. 4, to its extended position relative to outer body 52, as best seen in FIG. 5.

As piston 60 shifts, the operating fluid within upper chamber section 64*a* of chamber 64 is discharged into supply side 50*a* of fluid delivery subsystem 50, which energizes the fluid within fluid delivery subsystem 50. At the same time, return fluid from return side 50*b* of fluid delivery subsystem 50 enters lower chamber section 64*b* of chamber 64. As fluid delivery subsystem 50 is in fluid communication with retainer valve 38, shut-in valve assembly including first and second shut-in valves 44*a* and 44*b*, vent sleeve 40 and latch assembly 42, each of these components is actuated. More specifically, the energized fluid within fluid delivery subsystem 50 actuates retainer valve 38 to a closed position to prevent fluid loss from tubular string 30, actuates shut-in valve assembly 44 to a closed position to shut in the well, actuates vent sleeve 40 to an open position to bleeding off pressure between retainer valve 38 and the shut-in valve assembly 44 and actuates latch assembly 42 to an unlatched position to separate latch assembly portions 42*a* and 42*b* thereby separating tubular string 30 from the subsea well installation 20.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for separating a tubular string from a subsea well installation operably associated with a subsea well, the method comprising:

placing the tubular string in tension;

generating an output signal with a subsea controller responsive to a predetermined input signal received by the subsea controller;

receiving the output signal at a subsea actuator assembly and applying the tension force to the subsea actuator assembly;

energizing fluid in an operating fluid delivery subsystem in fluid communication with subsea actuator assembly and a retainer valve, a shut-in valve assembly, a vent sleeve and a latch assembly; and actuating the retainer valve, the shut-in valve assembly, the vent sleeve and the latch assembly responsive to the energized fluid including, closing the retainer valve, closing the shut-in valve assembly, opening the vent sleeve and energizing an unlatch mechanism in the latch assembly, thereby preventing fluid loss from the tubular, shutting in the well, bleeding off pressure between the retainer valve and the shut-in valve assembly and separating the tubular string from the subsea well installation.

2. The method as recited in claim 1 wherein applying a tension force on the tubular further comprises operating a heave compensator.

3. The method as recited in claim 1 wherein generating an output signal with a subsea controller responsive to receipt of a predetermined input signal by the subsea controller further comprises generating a hydraulic output signal and receiving an electrical input signal.

4. The method as recited in claim 1 wherein energizing fluid in an operating fluid delivery subsystem further comprises shifting a sleeve and releasing a locking assembly within the subsea actuator assembly, releasing a piston to move axially relative to a cylinder within the subsea actuator assembly and discharging a fluid in a chamber between the piston and the cylinder into the operating fluid delivery subsystem.

5. The method as recited in claim 1 wherein energizing fluid in an operating fluid delivery subsystem further comprises energizing a common hydraulic subsystem.

6. The method as recited in claim 1 further comprising receiving return fluid in the subsea actuator assembly from an operating fluid return subsystem in fluid communication with the retainer valve, the shut-in valve assembly, the vent sleeve and the latch assembly.

7. An apparatus for separating a tubular string from a subsea well installation, the apparatus comprising:

a heave compensator operable to place the tubular string in tension;

a subsea actuator assembly positioned within the tubular string having a piston initially fixed relative to a cylinder that define a chamber therebetween;

a subsea controller operably associated with the subsea actuator assembly;

a subsea safety tree operably associated with the tubular string including a retainer valve, a shut-in valve assembly, a vent sleeve and a latch assembly; and a fluid delivery subsystem in fluid communication with the chamber and the retainer valve, the shut-in valve assembly, the vent sleeve and the latch assembly, wherein an output signal of the subsea controller generated responsive to receipt of a predetermined input signal releases the piston such that the tension in the tubular string shifts the piston relative to the cylinder causing operating fluid within the chamber to energize the fluid delivery subsystem, thereby actuating the retainer valve, the shut-in valve assembly, the vent sleeve and the latch assembly.

8. The apparatus as recited in claim 7 wherein the heave compensator further comprises a riser tensioner.

9. The apparatus as recited in claim 7 wherein the output signal generated by the subsea controller further comprises a hydraulic output signal.

10. The apparatus as recited in claim 7 wherein the predetermined input signal received by the subsea controller further comprises an electrical input signal.

11. The apparatus as recited in claim 7 wherein the subsea actuator assembly further comprises a sleeve and a locking assembly that initially retain the piston fixed relative to the cylinder, the sleeve operable to be shifted from a first position in which the sleeve radially secures the locking assembly relative to the piston and a second position in which the sleeve allows radial movement of the locking assembly relative to the piston, thereby releasing the piston.

12. The apparatus as recited in claim 7 wherein the fluid delivery subsystem further comprises a common hydraulic subsystem.

13. The apparatus as recited in claim 7 wherein the retainer valve is actuated to a closed position to prevent fluid loss from the tubular string, the shut-in valve assembly is actuated to a closed position to shut in the well, the vent sleeve is actuated to an open position to bleeding off pressure between the retainer valve and the shut-in valve assembly and the latch assembly is actuated to an unlatched position to separate the tubular string from the subsea well installation.

14. The apparatus as recited in claim 7 wherein the fluid delivery subsystem further comprises a fluid return subsystem in fluid communication with the chamber and the retainer valve, the shut-in valve assembly, the vent sleeve and the latch assembly.

15. An apparatus for separating a floating facility from a subsea well installation, the apparatus comprising:

a heave compensator operably associated with the floating facility;

a tubular string supported in tension by the heave compensator, the tubular string including a subsea safety tree operably associated with the subsea well installation, the subsea safety tree including a retainer valve, a shut-in valve assembly, a vent sleeve and a latch assembly;

a subsea actuator assembly positioned within the tubular string having a piston initially fixed relative to a cylinder that define a chamber therebetween;

a subsea controller operably associated with the subsea actuator assembly; and a fluid delivery subsystem in fluid communication with the chamber and the retainer valve, the shut-in valve assembly, the vent sleeve and the latch assembly, wherein an output signal from the subsea controller releases the piston such that the tension in the tubular string shifts the piston relative to the cylinder causing operating fluid within the chamber to energize the fluid delivery subsystem to actuate the retainer valve, the shut-in valve assembly, the vent sleeve and the latch assembly.

16. The apparatus as recited in claim 15 wherein the output signal generated by the subsea controller further comprises a hydraulic output signal.

17. The apparatus as recited in claim 15 wherein the subsea actuator assembly further comprises a sleeve and a locking assembly that initially retain the piston fixed relative to the cylinder, the sleeve operable to be shifted from a first position in which the sleeve radially secures the locking assembly relative to the piston and a second position in which the sleeve allows radial movement of the locking assembly relative to the piston, thereby releasing the piston.

18. The apparatus as recited in claim 15 wherein the fluid delivery subsystem further comprises a common hydraulic subsystem.

19. The apparatus as recited in claim 15 wherein the retainer valve is actuated to a closed position to prevent fluid loss from the tubular string, the shut-in valve assembly is actuated to a closed position to shut in the well, the vent sleeve is actuated to an open position to bleeding off pressure between the retainer valve and the shut-in valve assembly and the latch assembly is actuated to an unlatched position to separate the tubular string from the subsea well installation.

* * * * *